United States Patent [19]

Bentz

[11] Patent Number: 4,496,305

[45] Date of Patent: Jan. 29, 1985

[54] IGNITION CONTROL CIRCUIT FOR A BOILER SYSTEM

[75] Inventor: Joseph W. Bentz, Clinton, Conn.

[73] Assignee: Precision Timer Co., Inc., Westbrook, Conn.

[21] Appl. No.: 522,522

[22] Filed: Aug. 12, 1983

Related U.S. Application Data

[63] Continuation-in-part of Ser. No. 387,246, Jun. 10, 1982, abandoned.

[51] Int. Cl.[3] ..... F23C 11/04

[52] U.S. Cl. ..... 431/1; 431/31; 431/19; 431/69; 122/24

[58] Field of Search ..... 431/1, 31, 69, 70, 19; 122/24

[56] References Cited

U.S. PATENT DOCUMENTS

| | | | |
|---|---|---|---|
| 4,192,641 | 3/1980 | Nakagawa et al. | 431/31 |
| 4,370,126 | 1/1983 | Miyanaka et al. | 431/31 |
| 4,395,224 | 7/1983 | Cade | 431/31 |
| 4,415,328 | 11/1983 | Grunden et al. | 431/1 |

*Primary Examiner*—Carroll B. Dority, Jr.

*Attorney, Agent, or Firm*—Costas, Montgomery & Dorman

[57] ABSTRACT

An ignition system for a furnace or boiler where a predetermined number of firing pulses are generated between timing intervals to allow purging of the combustion chamber. If combustion occurs, the firing pulses are terminated. If combustion does not occur, after the predetermined number of firing pulses, the combustion chamber is purged and the system shut down.

10 Claims, 7 Drawing Figures

IGNITION CONTROL CIRCUIT FOR A BOILER SYSTEM

RELATED APPLICATIONS

This application is a continuation-in-part of application Ser. No. 387,246 filed June 10, 1982, and now abandoned.

FIELD OF THE INVENTION

This invention relates to ignition systems for combustible charges of fuel as for example, gas fired boilers or furnaces.

BACKGROUND OF THE INVENTION

The invention is particularly adaptable for use in pulse combustion apparatus, although not limited thereto. Typically, pulse combustion apparatus includes a combustion chamber and an exhaust line which may form a resonant system with the combustion chamber. The apparatus operates on a cycle in which a fuel charge is injected into the combustion chamber and ignited, and the charge then expands into the exhaust pipe, causing a partial vacuum in the combustion chamber which both assists in drawing in a fresh fuel charge and causes high temperature gas to be drawn back into the combustion chamber from the exhaust pipe to ignite the fresh fuel. The fresh fuel charge is ignited spontaneously from flame fronts in the returning high temperature gas, thereby establishing the next cycle. The apparatus is self-sustaining in combustion after initial ignition. The exhaust line is utilized as a heat exchanger to heat another medium, such as water or air.

The present invention is concerned with an ignition system for a boiler in which a series of ignition pulses may be generated in given time intervals between combustion chamber purge periods to ignite the fuel in the combustion chamber. If ignition does not occur after a predetermined number of cycles, the ignition system is shut down.

The present system is solid state in design, thus obviating wear on the gearing, contacts, etc. of electromechanical timers and provides an ignition system for a combustion chamber which is simple in construction and long in life.

SUMMARY OF THE INVENTION

The invention utilizes a pair of pulse generators to generate relatively long time periods during which time periods, a combustion chamber is purged, and generate relatively short time periods, during which time periods, an ignition device in the combustion chamber is fired. The output pulses of the pulse generators are applied to a counter which acts as a frequency divider. The output of the counter will change state upon overflow and generate either a relatively short firing pulse or a relatively long purge period. The firing pulses are counted and if combustion does not occur after a predetermined number of firing pulses, the system is shut down. The timing system has no moving parts or contacts, and is of high reliability and long life. Provision is further made to disable the system in the event a circuit failure might occur which could lead to the gas valve remaining on with no ignition.

An object of this invention is to provide a new and improved timing and ignition circuit for a boiler.

DETAILED DESCRIPTION OF THE ILLUSTRATED EMBODIMENT

Figure 1:
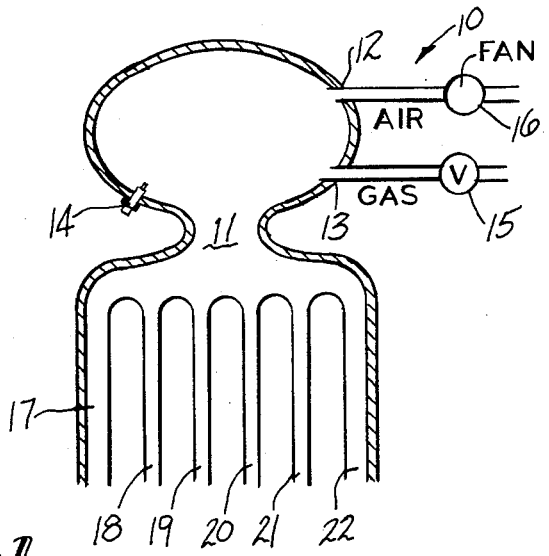
FIG. 1 is a representation of a pulse combustion boiler.

FIG. 1 represents a pulse combustion boiler 10 which comprises a combustion chamber 11 having an inlet 12 for air and an inlet 13 for gas. An ignition device such as a spark plug 14 extends into the combustion chamber 11. Gas is supplied through a valve 15 which may be solenoid actuated, and air is supplied from the outside by means of a blower or fan 16. In operation, gas and air are admitted into the combustion chamber 11 to form a combustible mixture which is ignited by the spark plug. The pressure resulting from the combustion process forces hot gases through tubes 17, 18, 19, 20, 21 and 22 of a heat exchanger, where a surrounding medium, such as water, absorbs the heat after the initial ignition, if combustion occurs. Residual heat from the combustion ignites the second and subsequent air-gas mixtures without the need for further use of the spark plug. After combustion, the blower or fan need not be operated since air will be drawn in due to the vacuum caused by the exhaust velocity through the heat exchange tubes 17–22. A pressure operated switch (not shown in FIG. 1) is also in communication with the combustion chamber.

Figure 2:
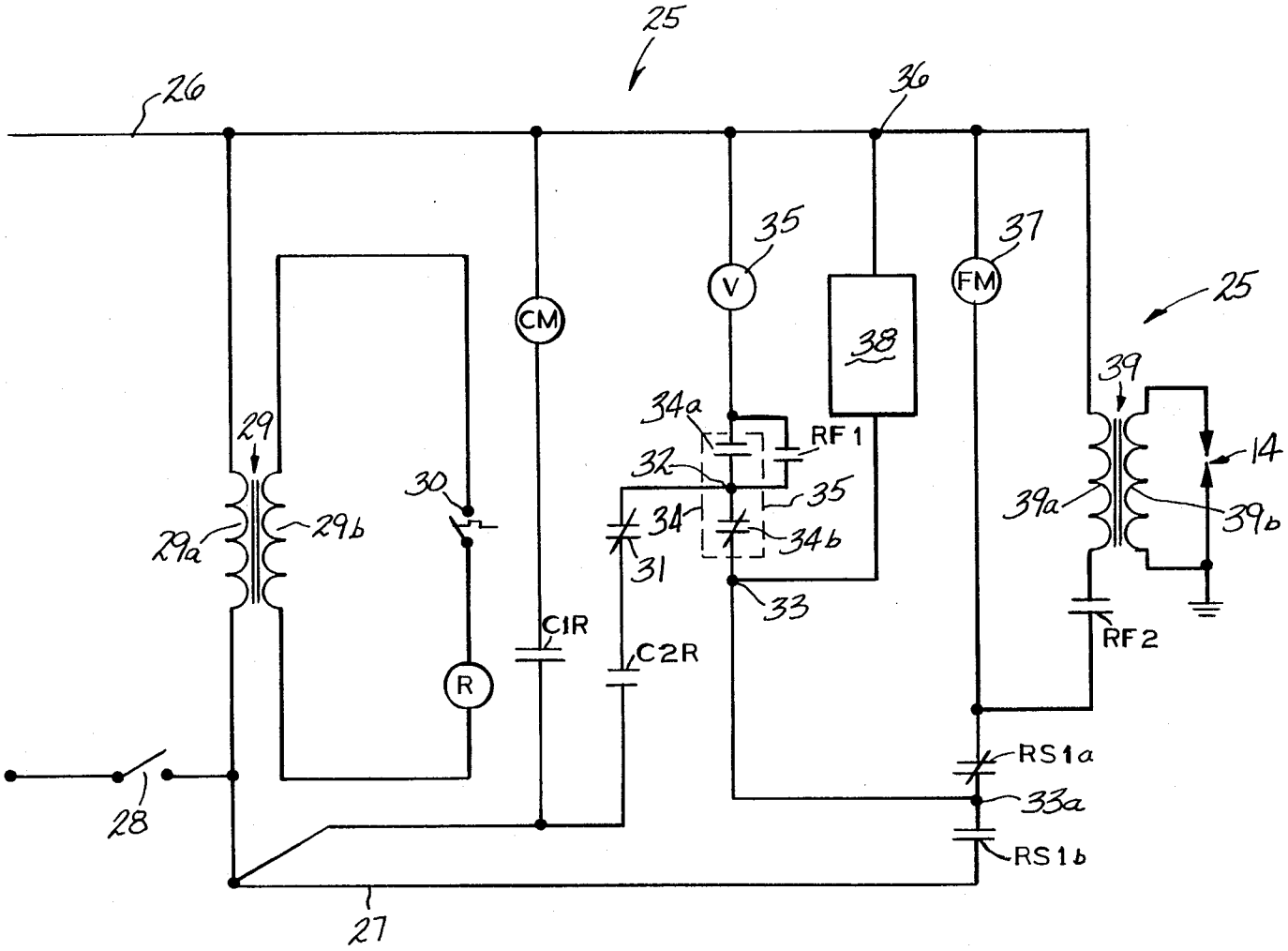
FIG. 2 is a schematic diagram of a control circuit for a gas fired boiler.

Reference is now made to FIG. 2, which shows a control circuit 25 for the boiler of FIG. 1. Circuit 25 comprises two bus lines 26 and 27. An On-Off switch 28 will provide voltage to the primary winding 29*a* of a stepdown transformer 29, when closed. The voltage applied to the secondary 29*b* of transformer 29 will energize a relay R when a thermostatic switch 30, calling for heat, is closed. When relay R is closed, it will pick up its contacts C1R and C2R. This will turn on a circulator motor CM to circulate hot water if that is the medium being heated by the lines 17–22. When contact C2R is closed, it provides a circuit through a normally closed high temperature limit switch 31 to a point 32. Point 32 is connected through a normally open contact 34*a* to an electrically operated gas valve 35. Contacts 34*a* and 34*b* are part of the pressure sensing switch 34 which senses combustion in the combustion chamber 11. Point 32 is connected to a point 33 through contact 34*b*. Between point 33 and point 36 is provided a timing and ignition control network 38, hereinafter described.

A fan or blower motor 37 is connected between line 26 and a point 33*a* through a normally closed contact RS1*a*, which is part of a double throw switch hereinafter described. Also connected between line 26 through a contact RF2, is the primary 39*a* of a transformer 39, whose secondary 39*b* is connected across spark plug 14.

As thus far described, when On-Off switch 28 is closed, and the thermostatic switch 30 calls for heat, circulator motor CM will be turned on when contact C1R closes. Gas valve 34 will be turned on when contact RF1 closes. When a timing sequence is initiated, fan motor 16 will begin to operate. Fan 16 removes any residual gases from the combustion chamber 11. A spark will be created by spark plug 14, as hereinafter described.

Figure 3:
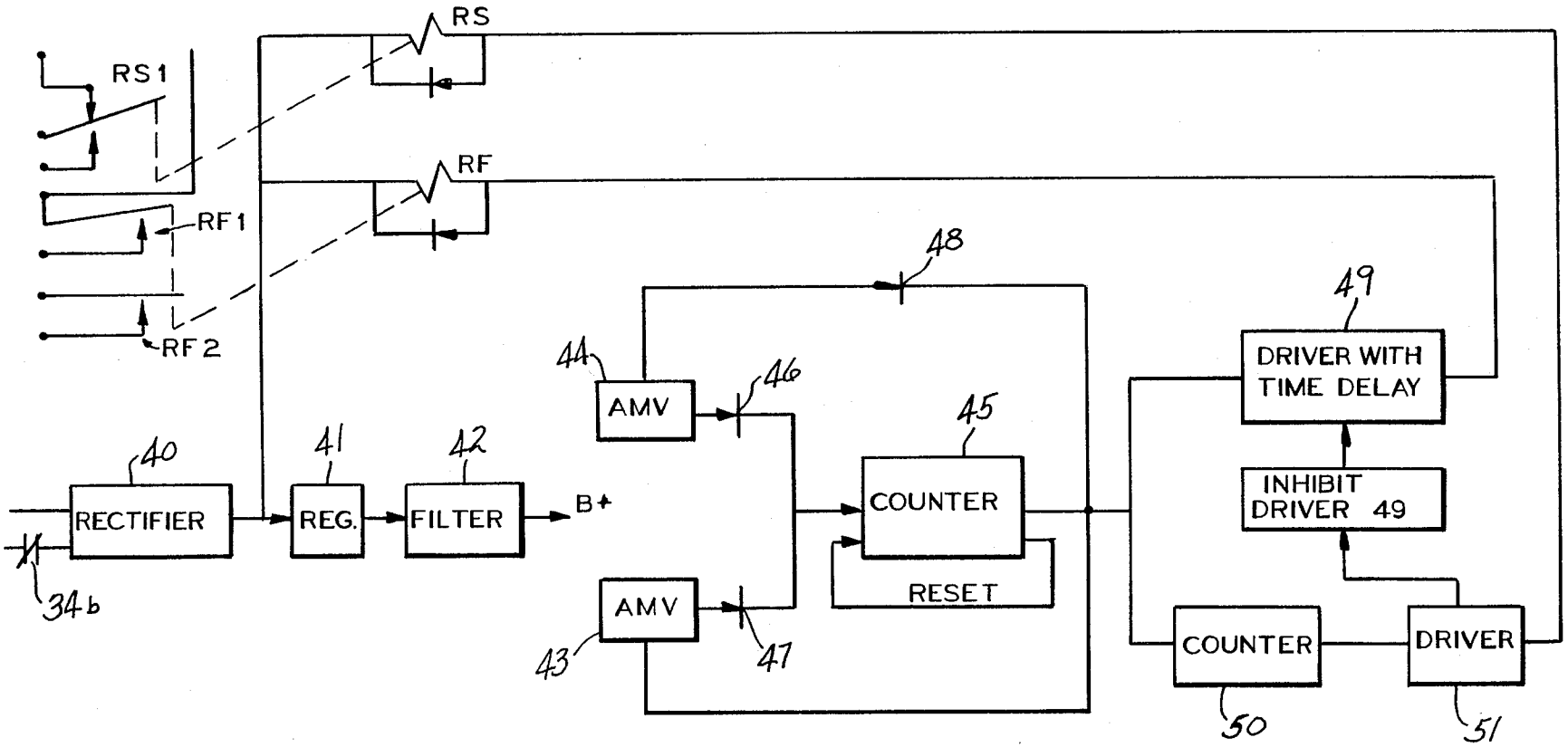
FIG. 3 is a diagram, partly schematic and partly in block form, of a control circuit embodying the invention.

The circuit 38 of FIG. 2 is shown in detail in FIG. 3. The AC line voltage is rectified in a rectifier 40, decreased in value to the operating value of the solid state components by a voltage regulator 41, followed by a filter 42, to supply B+ to the system. A pair of pulse generators in the form of astable multivibrators (AMV) 43 and 44, provide inputs to a down counter 45 through isolating diodes 46 and 47, respectively. Counter 45, in the embodiment shown, is a down counter which divides the input frequency by sixty-four and will provide an output upon overflow of the counter. So long as there is no output (low state) from counter 45, AMV 44 is held inoperative. AMV 44 is coupled to the output of counter 45 through a diode 48.

The period of AMV 43 is substantially longer than the period of AMV 44. For purposes of this disclosure, the period of output of AMV 43 will be considered to be 0.488 seconds, while the period of AMV 44 will be considered to be 0.076 seconds. With this relationship, it may be seen that it will take approximately six times as long for counter 45 to overflow and provide an output when pulses from AMV 43 are applied thereto, as compared to when pulses from AMV 44 are applied thereto.

When B+ is applied to the system, AMV 43 will become operative, but AMV 44 is held off by virtue of its logic and connection to the output of the counter 45. Counter 45 is a power-up counter which is reset when voltage is first applied. The output of counter 45 will change state each time it overflows. Counter 45 will increment or decrement, if in the form of a down counter, for sixty-four cycles of AMV 43, at which time counter 45 will overflow and provide a high output. In the examples given, it will take approximately thirty-one seconds to overflow with an input from AMV 43. At this point, AMV 44 becomes operative and will supply higher frequency pulses to counter 45, which will then count again to sixty-four. However, the count of sixty-four will now be reached in approximately five seconds. After this overflow pulse from counter 45, the output will go low, AMV 43 will then take control of counter 45 for another approximately thirty second period. The output of counter 45 is applied to a relay driver 49 having a small time delay for purposes hereinafter described. Driver 49 will energize relay RF. When energized, relay RF will pick up its contacts RF1 and RF2. When RF1 is closed, it opens gas valve 15 and RF2 is closed to provide a circuit to the primary of transformer 39 and the ignition device 14. During the first thirty second interval, fan motor 16 is operating to purge the combustion chamber 11.

The output of counter 45 is also applied to a decimal counter 50, which will count to a predetermined number, say five, and supply another relay driver 51 which applies a disabling signal to driver 49. A time delay is built into driver 49 so that if the counter 50 counts five pulse outputs from counter 45 and ignition has not occurred, it will disable driver 49 before output of the fifth pulse thereto because of the time delay. Counter 50 will also supply an output to relay driver 51 which will energize relay RS and cause it to close its contact RS1. This will open the circuit to the primary of transformer 39 and prevent the application of any further firing pulses to the combustion chamber.

It at any time combustion occurs during the five second pulses, this is sensed by pressure switch 34. Contact **34*b* opens and removes B+ from the system of FIG. 3, which then shuts down. Fan 16 will now be turned off and air will be pulled into the combustion chamber 11, due to the vacuum created by combustion. The boiler will now operate until the selected temperature is reached and thermostatic switch 30** opens.

If combustion should not occur within four pulse outputs of counter 50, relay driver 51 will energize relay RS approximately thirty-one seconds after the fourth firing pulse, and the system will be shut down and locked out.

The delay in applying the firing pulses to the primary of transformer 39 permits an approximately thirty-one second purge time of the chamber 11 after the fourth and final attempted firing pulse of a series. The time delay in driver 49 may be an RC circuit in the input. The driver 49 may then be inhibited by a contact of relay RS closing, to ground the capacitor of the RC circuit.

Figure 4A:
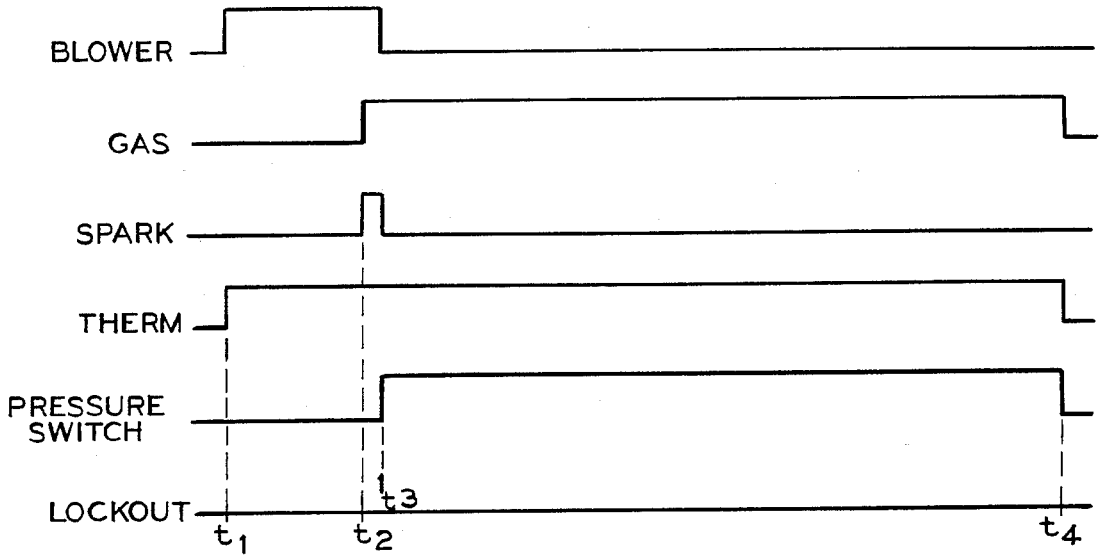
FIGS. 4*a* and 4*b* are timing diagrams helpful in understanding the operation of the circuit of FIG. 3

FIGS. **4*a* and 4*b* exemplify operation of the network where ignition occurs, and where there is a failure to ignite. FIG. 4*a* exemplifies initiation of combustion on the first firing pulse; the thermostatic switch closes at time $t_1$. The blower turns on. There is then a delay until time $t_2$, during which time counter 45 is counting the pulses of AMV 43. When an ignition pulse occurs at time $t_2$, the gas valve 34 is opened and gas is admitted to chamber 11. Then between times $t_2$ and $t_3$, ignition will occur, at which time pressure switch 35 senses combustion and disables the circuit. Simultaneously, fan motor 16 is turned off. The boiler will continue to operate by self-combustion, as previously described, until time $t_4$, when thermostatic switch 30** opens. At this time, relay R is de-energized and opens its contacts C1R and C2R to remove power from the system.

FIG. **4*b* exemplifies repetitive firing of the sparkplug 14 for a period of four pulses, during which pulse times the gas valve is open. During this time, the blower is continually going and will operate for a selected period of time after the last pulse, to provide a post purge of the combustion chamber 11. At time $t_4$, after counter 50 has sensed the fifth pulse output from counter 45 and while such fifth output pulse is delayed in driver 49**, relay RS is energized to reverse its contacts RS1 and lock out the ignition system.

Thereafter, the overall system may be inspected to determine the cause of non-combustion.

Figure 5:
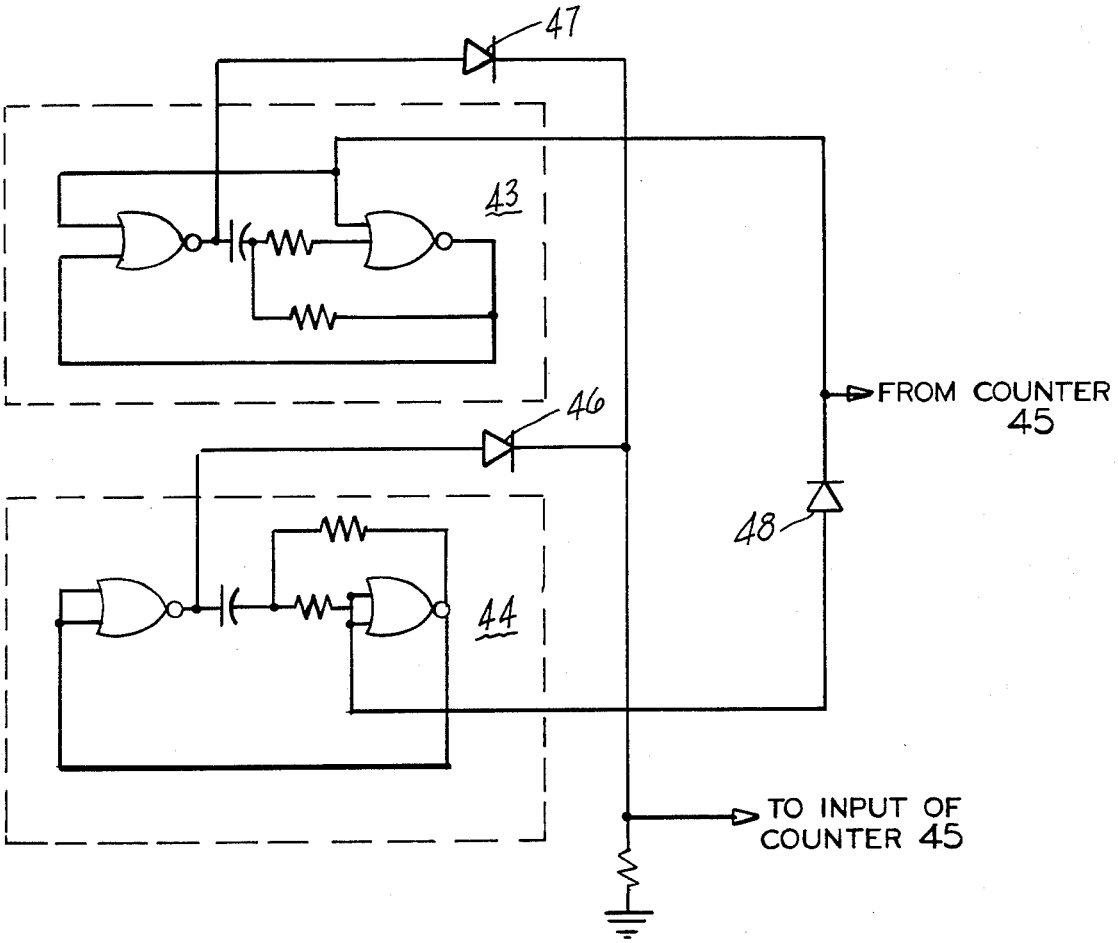
FIG. 5 is a schematic diagram of astable multivibrators of FIG. 3.

FIG. 5 exemplifies the AMVs 43 and 44. The AMVs are formed of NOR gates, typically a CD4001B integrated circuit, as shown on page 50, RCA SOLID STATE COS/MOS INTEGRATED CIRCUITS, 1980.

It will be noted that gas valve 35 cannot be turned on unless thermostat switch 30 is closed, and contact RFI or **34*a* is closed. Moreover, the control circuit 38 of FIG. 3 cannot be operative unless contact 34*b* (combustion pressure switch) is closed. The gas valve is turned on when relay RF is energized by an ignition pulse from driver 49. When relay RF is energized it also closes its contact RF2 to energize the primary 39*a* of transformer 39**.

Provision is made to guard against the possibility of a failure of the circuit of FIG. 3 which could lead to the gas valve being on continuously. This could occur in the event there was no combustion sensed by pressure switch 34 and no output from counter 50, or the previously described lockout did not occur. Continuous application of gas to the combustion chamber, and subsequent venting of gas to the atmosphere through the air intake, could occur in the event of a circuit component failure. To guard against this possibility, provision is made to take control of the system away from the thermostat and impair the circuit so that it completely shuts down.

Figure 6:
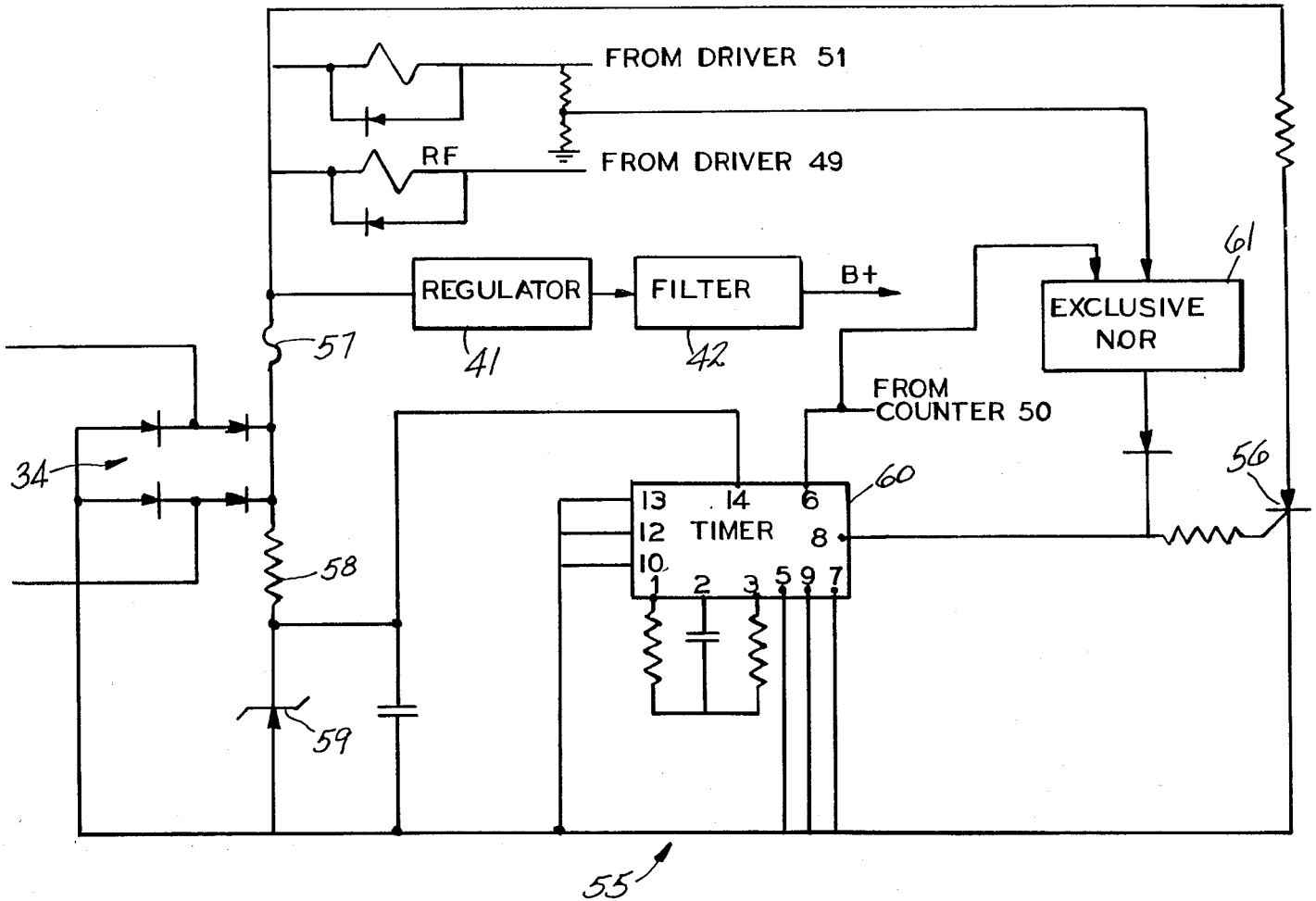
FIG. 6 is a schematic diagram of a system disabling network.

Reference is made to FIG. 6 taken in conjunction with FIG. 3. Some components of FIG. 3 are set forth in FIG. 6. A power disabling circuit 55 includes a silicon controlled rectifier (SCR) 56 which is connected across a fuse 57, the output of rectifier 34, a resistance 58, and a zener diode 59. SCR 56 is normally non-conductive, but if it becomes conductive, it will draw sufficient current to blow fuse 57. This will interrupt power to the circuit of FIG. 3, and cause relays RS and RF to be reset. When relay RF is reset, gas valve 35 is turned off when contact RF1 (FIG. 2) opens. Contact RF2 opens the circuit to the primary of transformer 39.

Figure 4B:
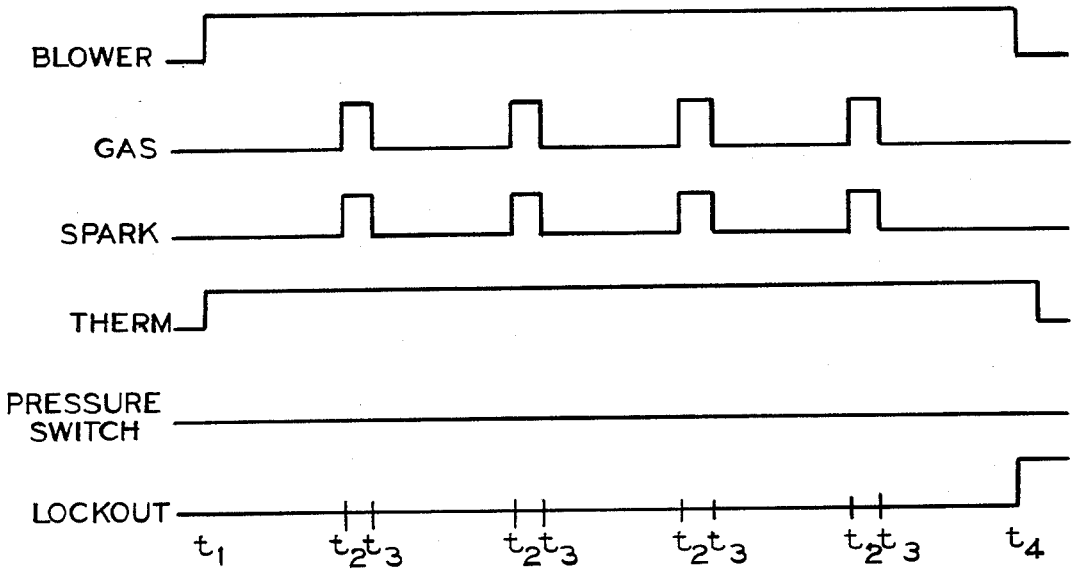

SCR 56 is turned ON by a signal from pin 8 of a programmable timer 60 which may be a Motorola 4541B oscillator-counter. Timer 60 is a power-up timer and is set to count a number of pulses from an oscillator portion which occur over a slightly greater time period $t_o$ than time period $t_1$–$t_4$ of FIGS. 4*a* and 4*b*. For example, if the time $t_1$–$t_4$ is approximately 246 seconds, then the period $t_o$ of timer 60 may be set to approximately 300 seconds. At the end of time $t_o$, timer 60 applies an input signal to SCR 56, causing SCR 56 to turn ON and draw sufficient current to blow fuse 57. However, if there is a normal output from counter 50, FIG. 3, after five ignition pulses a reset signal from counter 50 to pin 6 of timer 60 resets the counter portion, and timer 60 awaits removal of this reset signal to again start timing. If combustion occurs then, power to the circuits of FIGS. 3 and 6 is interrupted, control of the operation of the system remains under the control of thermostat 30, and power is removed from the circuits of FIGS. 3 and 6, and previously described.

If combustion does not occur and the circuit of FIG. 3 operates normally, lock-out will occur as previously described, and timing of period $t_o$ will be halted by the reset signal to pin 6 of timer 60.

When counter 50 counts five ignition pulses and supplies an output, such output will reset timer 60, as well as provide the intended lockout function. However, if there is no output from counter 50, timer 60 will time out, turn SCR 56 ON, fuse 57 will blow and the system will shut down.

An exclusive NOR gate 61 is adapted to receive inputs from counter 50 and timer 60. If these two inputs are present simultaneously, gate 60 will apply an enabling signal to the gate electrode of SCR 56. This will protect against a possibility of a lockout signal being generated by timer 50 and driver 51, but failure of relay RS.

It may thus be seen that the objects of the invention set forth as well as those made apparent are efficiently attained. Since changes may be made in the disclosed embodiment of the invention without departing from the spirit and scope of the invention, it is intended that the appended claims cover all embodiments and medications of the invention which do not depart from the spirit and scope of the invention.

Having thus described the invention, what is claimed is:

1. A circuit for providing a predetermined number of pulses between predetermined time intervals comprising first and second pulse generators, said first generator providing pulses having a substantially longer period than said second generator, a pulse counter providing an output upon overflow, means coupling said pulse generators to said counter, said second generator being inhibited by absence of one output state of said counter, but rendered active upon occurrence of the other output state of said counter, whereby when said first generator is operating, said counter generates an output pulse upon overflow and enables said second generator, and terminates the output pulse upon overflow of counts of pulses from said second generator, means applying the overflow from said counter due to said first generator to an ignition circuit, means for counting the number of pulses applied to said ignition circuit, and means responsive to said means for counting reaching a predetermined number for inhibiting input of pulses to said ignition circuit.

2. The circuit of claim 1, further comprising means for delaying application of pulses to said ignition circuit behind application of pulses to said means for counting whereby when said means for counting counts the last of said predetermined number of pulses, said means for inhibiting prevents the last of said predetermined number of pulses from being applied to said ignition circuit.

3. The circuit of claim 1, wherein said ignition pulses are applied to a combustion chamber to produce combustion therein, means for sensing combustion in said chamber, said sensing means being effective to terminate generation of ignition pulses.

4. A system for igniting fuel in the combustion chamber of a boiler having a fuel inlet and a line thereto, an electrically operated valve in said fuel line, an air inlet and a line thereto, a fan in said air line, a thermostatic switch, an ignition device in the combustion chamber, a circuit including said switch, said ignition device, said valve and said fan, means for generating ignition pulses having a predetermined period and time spaced by predetermined intervals of substantially longer period than the pulse period, means responsive to said switch for operating said fan, said pulse generating means being responsive to said switch to commence generating said ignition pulses after a time period equal to said longer time period, means for opening said gas valve upon occurrence of said ignition pulses, means for time delaying application of ignition pulses to said ignition device, means for counting ignition pulses prior to delay, means responsive to said counting means reaching a predetermined count for inhibiting application of ignition pulses to said ignition device whereby said fan is operated for said longer time period after the last ignition pulse is applied to said ignition device.

5. The circuit of claim 4 further including timing means responsive to said switch for timing a predetermined cycle longer than the sum of the times of said ignition pulses and said intervals and providing an output signal, and means responsive to said output signal for disabling said system in the absence of a signal from said counting means.

6. The system of claim 5 where a signal from said counting means resets said timing means.

7. The system of claim 4 further including timing means responsive to said switch for timing a predetermined cycle longer than the sum of the times of said ignition pulses and said intervals and providing an output signal, and means responsive to the output signal of said timing means and a signal from said counting means for disabling said system.

8. A system for igniting fuel in the combustion chamber of a boiler having a fuel inlet and a line thereto, an electrically operated valve in said fuel line, an air inlet and a line thereto, a fan in said air line, a thermostatic switch, an ignition device in the combustion chamber, a circuit including said switch, said ignition device, said valve and said fan, means for generating ignition pulses having a predetermined period and time spaced by predetermined intervals of substantially longer period than the pulse period, means responsive to said switch for operating said fan, said pulse generating means being responsive to said switch to commence generating said ignition pulses after a time period equal to said longer time period, means for time delaying application of ignition pulses to said ignition device, means for opening said gas valve in timed relation with occurrence of ignition pulses to said ignitition device, means for counting ignition pulses prior to delay, means responsive to said counting means reaching a predetermined count and providing a signal for inhibiting further application of ignition pulses to said ignition device, timing means having a timing period greater than the sum of the periods of said pulses and said predetermined intervals, said timing means being responsive to said switch and providing an output signal at the end of its timing period, means responsive to said output signal for disabling said system in the absence of a signal from said counting means.

9. The system of claim 8 where the signal from said counting means resets said timing means.

10. The system of claim 8 further including means responsive to the output signal of said timing means and a signal from said counting means for disabling said system.

* * * * *